United States Patent [19]

Douglas et al.

[11] 4,381,016

[45] Apr. 26, 1983

[54] CLEANING FLUID DISTRIBUTION HEAD

[76] Inventors: Robin S. Douglas, 28381 Mount Stephen Ave., Canyon Country, Calif. 91351; John M. Sweeney, 43050 Lemonwood Dr., Lancaster, Calif. 93534

[21] Appl. No.: 281,073

[22] Filed: Jul. 7, 1981

[51] Int. Cl.[3] ..... B08B 3/02; B08B 9/02

[52] U.S. Cl. ..... 134/170; 134/171

[58] Field of Search ..... 134/166 C, 170, 171

[56] References Cited

U.S. PATENT DOCUMENTS

| | | | |
|---|---|---|---|
| 2,788,008 | 4/1957 | Wanzer | 134/170 X |
| 4,228,927 | 10/1980 | Beyens et al. | 134/166 C X |
| 4,294,271 | 10/1981 | Intrater et al. | 134/171 X |

FOREIGN PATENT DOCUMENTS

| | | | |
|---|---|---|---|
| 47927 | 4/1890 | Fed. Rep. of Germany | 134/170 |

*Primary Examiner*—Robert L. Bleutge

*Attorney, Agent, or Firm*—Wagner & Bachand

[57] ABSTRACT

A cleaning head for cleaning elongated tubes having multiple separate paths for different cleaning fluids to be supplied in sequence, and an impeller adapted to throw a first portion of the cleaning fluid centrifugally onto the tube inner wall, and to pass a second portion axially of the tube for subsequent mergence with the first portion, and an outer plenum directing cleaning fluid onto the tube exterior, for cleaning the entire tube top to bottom and inside and out.

21 Claims, 6 Drawing Figures

CLEANING FLUID DISTRIBUTION HEAD

TECHNICAL FIELD

This invention has to do with cleaning apparatus and more particularly with fluid distribution heads for the efficient cleaning of elongated tubes such as quartz tubes used for oxidation, diffusion and low temperature chemical vapor deposition in semiconductor manufacturing operations. Such tubes need to be periodically washed and thoroughly rinsed.

BACKGROUND ART

The difficulty of covering all interior surfaces of the tubes from the very top down to the bottom is compounded by the need to wash the tubes sequentially with a series of different cleaning fluids as a part of the recommeded cleaning procedure. Thus, for example a tube may be subjected in sequence to successive washes of mixed nitric acid and hydrofluoric acid, water and nitrogen, this series being followed by a dilute acid wash, e.g. a 5% solution of hydrofluoric, and finally a water rinse. Because of different wash requirements during a cleaning cycle, and the need to segregate the wash solutions, multiple fluid supplies and multiple flow passages are required. In addition to these requirements, the chemically aggressive nature of the wash solutions dictates fabrication of cleaning equipment from chemically inert materials such as high performance plastics.

Accordingly there is a need for tube washing apparatus meeting the several requirements outlined, and particularly for a cleaning fluid distribution head providing complete coverage of the tube interior, while maintaining separate flow paths for the several fluids used in sequence.

DESCRIPTION OF THE INVENTION

It is therefore an object of the invention to provide such washing apparatus, and specifically a cleaning fluid distribution head providing complete coverage of the tube interior while maintaining separate flow paths for the several fluids to be used in sequence. It is another object to provide positive impingement of cleaning fluids on the tube inner walls opposite the head. Still another object is to provide simultaneous radial and axial flow of cleaning fluids relative to the tube for cleaning the length of the tube. Yet another object is to provide a highly advantageous plug shaped distribution head having multiple transverse flow passages at different axial planes communicating selectively with selected ones of a series of axial passages, and a cooperating depending impeller for separate delivery of multiple fluids, with each fluid operating the impeller to centrifugally throw a first portion of the cleaning fluid onto the tube inner wall while passing a second portion of the fluid axially of the tube through gaps defined by the impeller blades. It is a still further object to provide means for simultaneously cleaning the outer wall of the tube.

These and other objects of the invention to become apparent hereinafter are realized in accordance with the invention in a cleaning fluid distribution head for cleaning elongated tubes, comprising structure adapted for endwise reception in a tube to be cleaned, the structure defining a series of flow passages communicating respective sets of inlet and outlet ports for separate delivery of different fluids to the tube for tube cleaning, the outlet ports being of a number and position to direct the fluids generally axially of the tube without contact of the fluid with adjacent tube inner wall, and means carried by the structure within the tube adapted and arranged to rotate responsive to impingment of cleaning fluids thereon from any of the outlets and thereby to redirect a first portion of outlet port delivered fluids centrifugally laterally outward onto the adjacent tube inner wall for sheet flow thereon, and to pass a second portion of the delivered fluids axially of the tube for mergence beyond the means with the redirected fluid portion on the tube inner wall, whereby the entire tube inner wall is subjected to cleaning fluids.

In particular embodiments, the invention includes means beyond the tube supporting the structure within the tube and the fluid redirecting means inwardly of the tube inner wall.

Typically, the cleaning fluid distribution head structure includes a plug shaped body having a longitudinal axis, a series of transverse bores extending within the body from respective ones of the inlets, and a series of axial bores extending within the body from respective ones of the outlets, the axial and transverse bores intersecting in paired relation to define separate passageways between the inlets and outlets for different fluids delivered to the tube. Preferably the transverse bores lie in different axial planes, at least two axial bores intersect each transverse bore, the intersecting bores terminate in outlets which are diametrically opposed, and the axial bores diverge outwardly within the body toward the outlets.

Additionally, the invention contemplates provision of a cleaning fluid supply to the distribution head structure and means delivering multiple different cleaning fluids sequentially to the structure.

In particular embodiments, there is further included means beyond the tube supporting the structure within the tube and the redirecting means inwardly of the tube inner wall, and tube outer wall cleaning means surrounding the tube substantially opposite the cleaning head structure; the outer tube wall cleaning means comprises a plenum, suitably integrally formed with the head structure support, carrying cleaning fluid under pressure around the outer tube wall, a plurality of nozzles directed at the outer tube wall from the plenum, and means supplying cleaning fluid under pressure to the plenum for delivery by the nozzles onto the outer tube wall; the head structure and its support are cooperatively threaded, and the plenum defines weep holes and a downward slope to its horizontal surfaces against accumulation of cleaning fluid thereon.

In particularly preferred embodiments, the fluid redirecting means comprises an impeller freely rotatable about its axis responsive to impingement by the cleaning fluids, the impeller comprising a plurality of blades extending outward from a common hub, the blades having a pitch angle deflecting impinging fluid laterally of the impeller and centrifugally onto the inner wall of the tube while simultaneously driving the impeller angularly. Preferably, the radial orientation and angular extent of the impeller blades is such that gaps are defined between adjacent blades in cleaning fluid axially passing relation.

In such embodiments, there is further included means beyond the tube supporting the structure within the tube, the impeller being disposed normally within the tube and inwardly spaced from the tube inner wall, the structure including a plug shaped body having a longitudinal axis coincident with the tube longitudinal aaxis, a series of transverse bores extending within the body from respective ones of the inlets, and a series of axial bores extending within the body from respective ones of the outlets, the axial and transverse bores intersecting in paired relation to define separate passageways between the inlets and outlets for different fluids to be delivered onto the impeller blades and therepast through the gaps to clean the tube along its entire length. As in previous embodiments, the transverse bores lie in different axial planes and generally parallel to the locus of rotation of the impeller, the axial bores being of different lengths with at least two axial bores extending to a given transverse bore plane to intersect with each the transverse bore, the intersecting bores terminating in outlets which are diametrically opposed and lie in a common plane with the impeller hub axis of rotation. The mentioned axial bores typically diverge outwardly within the body toward the outlets to deliver cleaning fluid radially outwardly and downwardly onto or between the impeller blades.

Still further the invention provides a housing adapted to overfit an end of the tube in upright orientation, the housing defining a central support for the head structure including means engaging an upper portion of the cleaning head, a plenum surrounding the head structure in radially spaced relation whereby the tube is received between the head and the plenum, a spindle extending axially from the head, the impeller being freely rotatably journaled on the spindle, the outlets being circularly distributed about the spindle for delivery of cleaning fluid onto and past the impeller for cleaning the interior of the tube, a plurality of nozzles directing fluid from the plenum generally radially inwardly for cleaning the exterior of the tube, the plenum and outlets being adapted to sequentially communicate in common with a series of different cleaning fluid supplies, means supplying different cleaning fluids, and means to collect the cleaning fluids after use.

THE DRAWINGS

The invention will be further described as to an illustrative embodiment in conjunction with the attached drawings in which.

PREFERRED MODES

Figure 1:
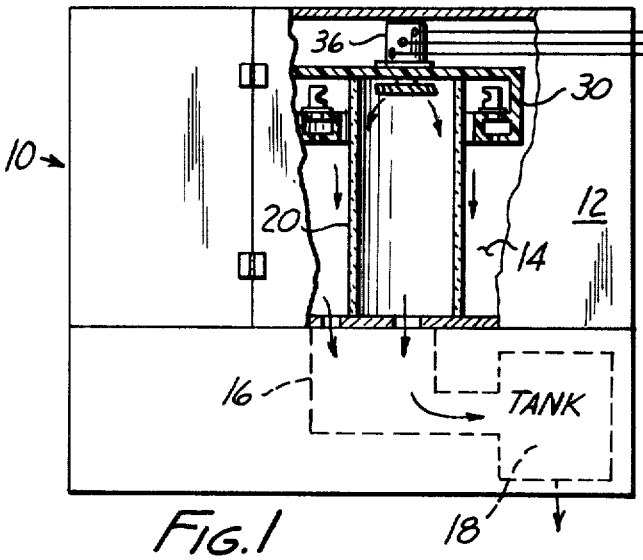
FIG. 1 is a front elevation view of a tube washing apparatus according to the invention having a multiple separate cleaning fluid supply.
Figure 5:
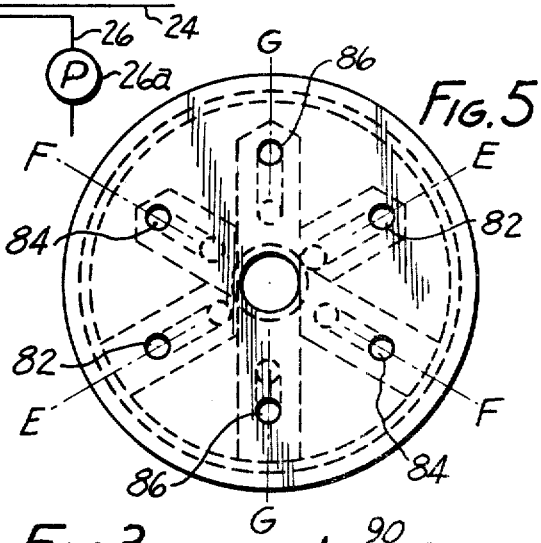
FIG. 5 is a transverse section view of the distribution head body taken on line 5—5 in FIG. 3.

Turning now the drawings in detail, in FIG. 1 a wash cabinet 10 is depicted having a door 12 closing off a wash chamber 14 behind. Beneath the wash chamber 14 a drain 16 leads to tank 18 for recovering the wash liquids put into the wash chamber 14. Tubes 20 to be cleansed are set upright within the wash chamber 14. Typically tubes 20 are made of quartz, are about 6 inches in diameter, and 6 feet or so in length. Cleaning fluids are supplied to the wash cabinet from multiple separate supplies e.g. lines 22, 24 and 26, or more or fewer supplies. For cleansing quartz, a mixed concentrated acid solution of nitric acid and hydrofluoric acid can be used in line 22, water in line 24 and nitrogen flush gas in line 26. Still more lines can be used, e.g. for dilute hydrofluoric acid rinse, or existing lines may be double used. A common pump 26*a* is used to circulate the acid liquids to the wash cabinet 10, the water and gases being under supply pressure.

The wash cabinet and cleaning fluid supply arrangement thusfar described is conventional. This invention is particularly concerned with an improved fluid distribution head to be used within the cabinet 10, and more particularly within the tubes 20 within the cabinet. Uniquely, the present invention enables the use of separate piping, eliminating cross-contamination problems, and at the same time provides for the delivery of cleaning fluids always at the same plane within the tube 20, unlike multiple piping, multiple cleaning head systems. The alternative of immersion is not practical, given the extremely corrosive nature of the acid solutions used.

In accordance with the invention a cleaning fluid distribution head is provided which completely cleanses the tube inner wall. With reference now to FIGS. 2 to 5, a housing 28 of suitably acid resistant plastic is molded or machined to have an outer cylindrical wall 30 and a circular top wall 32. Top wall 32 has a central opening 34 in which the plug shaped body 36 of the cleaning fluid distribution head 37 is supported by nut 47. The housing 28 is mounted to the wash chamber 14 wall by means not shown, but which is suitably a wedge shaped fitting enabling mounting and demounting of the housing readily. The housing wall 30 terminates downwardly in a per se known plenum 38 which communicates by means not shown with the cleaning fluid supply lines 22, 24, and or 26. The plenum 38 encircles the tube 20 and is provided with circularly arranged plural nozzles 40 threaded into tapped openings 42 whereby the nozzle throats 42*a* are open to the plenum. Throats 42*a* are shaped to deflect cleaning fluids laterally, onto the outer wall 44 of the tube 20. It will be noted that the plenum 38 defines downwardly opening weep holes 46 and sloping drain surfaces 48 against accumulations of cleaning liquids within or atop the plenum.

Figure 3:
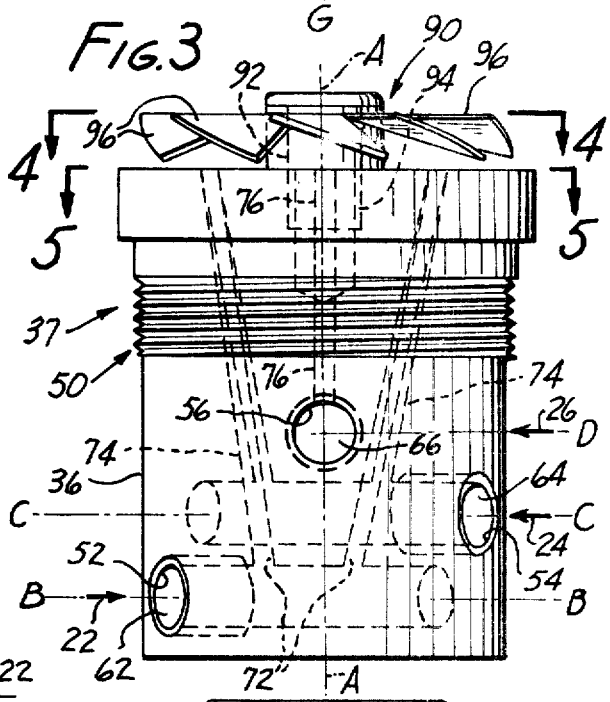
FIG. 3 is an enlarged view of the plug shaped body of the distribution head, with the several flow passage defining axial and transverse bores shown in phantom outline, the body being inverted from the other views.

Returning to the cleaning fluid distribution head 37, the plug shaped body 36 is generally cylindrical and slightly tapered along its longitudinal axis A—A. An intermediate portion 50 of the body 36 length is threaded for mounting cooperation with the nut 47. As best shown in FIG. 3, the body 36 has formed in one half thereof a series of transverse bores 52, 54, and 56, which lead inwardly through the body from body inlets 62, 64 and 66, respectively, these inlets comunicating with the cleaning fluid supply lines 22, 24 and 26 respectively. The transverse bores 52, 54, and 56 lie in different axial planes B—B C—C and D—D respectively, enabling separate passages for different cleaning fluids through the body 36, each keyed to a particular inlet.

Further provided in the body 36 is a series of axially disposed bores, arranged in diametrically opposed pairs, 72, 74 and 76. The axial bore pairs 72, 74 and 76, lie in respective vertical planes E—E, F—F, and G—G, each of which includes the longitudinal axis A—A of the body 36. Within their planes the axial bores 72, 74 and 76 diverge outward slightly from onset to termination at paired outlets 82, 84 and 86 for purposes to appear. It will be observed with reference to FIG. 3, that the several pairs of axial bores 72, 74 and 76, onset at different axial planes within the body 36, i.e. bore pair 72 onset at axial plane B—B, bore pair 74 at axial plane C—C, and bore pair 76 at axial plane D—D. In this manner, the communication of the various bore pairs is limited to the particular transverse bore at a given axial plane, and thus to a particular body inlet, and thereby to a particular cleaning fluid supply line. Additionally, by virtue of the described pairing of outlets, each particular fluid is delivered on either side of the body 36.

It is thus seen that by an ingenious arrangement of transverse and axial bores a plurality of separate flow passages are defined within tightly confined volume, the body 36 typically being less than 4 inches in diameter and less than 6 inches in height.

A further signal feature of the invention is the provision of means to distribute the cleaning fluids traversing the mentioned flow passages onto the inner wall of the tubes. For this purpose, an impeller 90 is provided, journalled on spindle 92 which is fixed in the body 36 in center socket 94. The impeller 90 rotates about the longitudinal axis A—A of the body 36. Fluid exiting the paired outlets 82, 84, or 86 is expelled at high velocities toward the impeller 90. Blades 96, arranged symmetrically about the impeller 90 axis are impinged by this fluid. The pitch of the impeller blades 96, see FIG. 3, and the angular divergence within the body 36 of the axial bores 72, 74 and 76, causes the impeller 90 to be driven about the spindle 92 at a high rate of speed, dependent on the fluid velocity. The spinning impeller 90 throws impinging fluid centrifugally out onto the surrounding tube inner wall portion 100 cleaning the most difficultly reached areas of the tube after which the fluid sheets out wetting the entire inner periphery of the tube 20, and moves downward, assuming the tube is in an upright position as shown.

Figure 4:
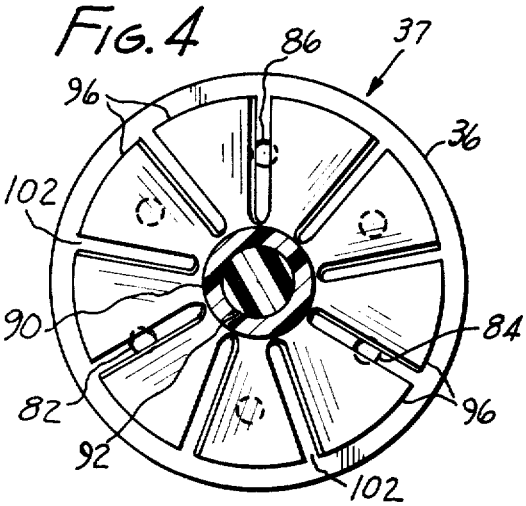
FIG. 4 is a plan view of the impeller end of the distribution head body taken on line 4—4 in FIG. 3.
Figure 2:
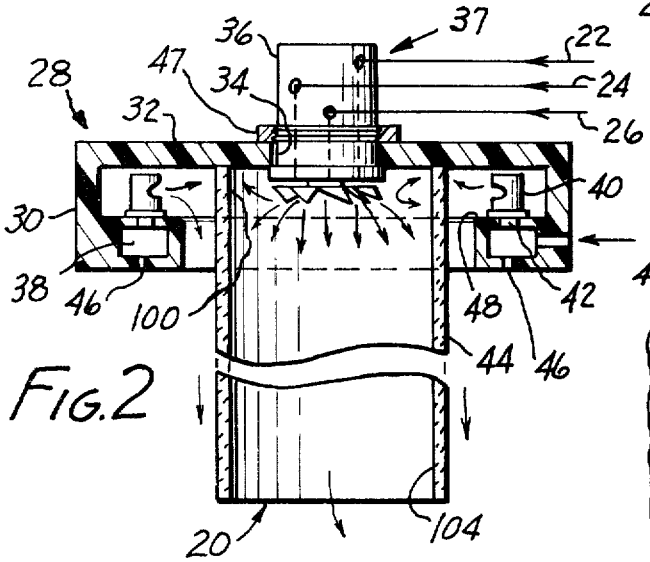
FIG. 2 is fragmentary view of the cleaning fluid distribution head according to the invention and surrounding plenum.
Figure 6:
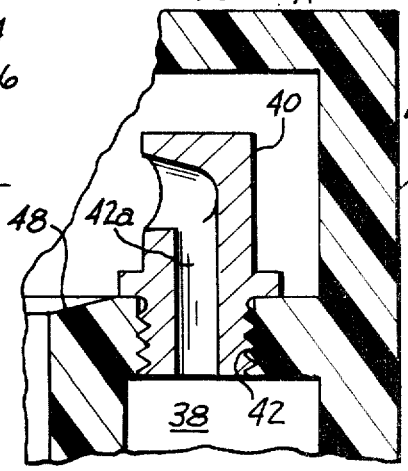
FIG. 6 is an enlarged fragmentary view of the nozzle feature of the invention.

With particular reference to FIG. 4, a further feature of the invention is illustrated. As shown, the impeller blades 96 have an angular extent such that adjacent blades are angularly spaced a distance defining between each pair of adjacent blades a gap 102. It will be observed that the outlets 82, 84 and 86 are exposable through the gaps 102. This enables a portion of the cleaning fluid not impinging on and deflected by the blades 96 to pass the plane of the blades, and move beyond the locus of rotation of the impeller 90, to impinge ultimately on the tube inner wall portions well below the impeller, e.g. at 104, where the fluid merges with the impeller deflected fluid in a common sheet for passage to the bottom of the tube 20.

In operation, the cleaning fluids are supplied along lines 22, 24 and 26, e.g. the concentrated hydrofluoric nitric acid mixture, followed by rinse water, nitrogen flush, further rinsing with dilute acid, further rinses and gas flushing, with the streams passed through e.g. inlet 22, transverse bore 62, axial bore 72 and out outlets 82, or other combination of lines, inlets, bores and outlets as necessary or desired to keep streams separated and cleaning processes sequenced.

There is thus provided a cleaning fluid distribution head having separately usable passages for delivery in sequence separate fluids, positive throwout of the fluids onto the surrounding tube, and axial throw of the fluid as well along the length of the tube, for effective cleaning of the tube interior walls from one end to the other. A cooperating plenum, part of the support housing for the mentioned head, simultaneously washes the tube exterior wall.

What is claimed is:

1. Cleaning fluid distribution head for cleaning elongated tubes, comprising structure adapted for endwise reception in a tube to be cleaned, said structure defining a series of flow passages communicating respective sets of inlet and outlet ports for separate delivery of different fluids to the tube for tube cleaning, said outlet ports being of a number and position to direct said fluids generally axially of the tube without contact of the fluid with adjacent tube inner wall, and means carried by said structure within said tube adapted and arranged to rotate responsive to impingement of cleaning fluids thereon from any of said outlets and thereby to redirect a first portion of outlet port delivered fluids centrifugally laterally outward onto the adjacent tube inner wall for sheet flow thereon, and to pass a second portion of said delivered fluids axially of said tube for mergence beyond said means with said redirected fluid portion on the tube inner wall, whereby the entire tube inner wall is subjected to cleaning fluids.

2. The cleaning fluid distribution head according to claim 1, including also means beyond said tube supporting said structure within said tube and said fluid redirecting means inwardly of said tube inner wall.

3. The cleaning fluid distribution head according to claim 1, in which said structure includes a plug shaped body having a longitudinal axis, a series of transverse bores extending within said body from respective ones of said inlets, and a series of axial bores extending within said body from respective ones of said outlets, said axial and transverse bores intersecting in paired relation to define separate passageways between said inlets and outlets for different fluids delivered to said tube.

4. The cleaning fluid distribution head according to claim 3 in which said transverse bores lie in different axial planes.

5. The cleaning fluid distribution head according to claim 3, in which at least two axial bores intersect each transverse bore, said intersecting bores terminating in outlets which are diametrically opposed.

6. The cleaning fluid distribution head according to claim 3, in which said axial bores diverge outwardly within said body toward said outlets.

7. The cleaning fluid distribution head according to claim 1, including also a cleaning fluid supply.

8. The cleaning fluid distribution head according to claim 1, including also means delivering multiple different cleaning fluids sequentially to said structure.

9. The cleaning fluid distribution head according to claim 1, including also means beyond said tube supporting said structure within said tube and said redirecting means inwardly of said tube inner wall, and tube outer wall cleaning means surrounding said tube substantially opposite said cleaning head structure.

10. The cleaning fluid distribution head according to claim 9, in which said outer tube wall cleaning means comprises a plenum carrying cleaning fluid under pressure around said outer tube wall, a plurality of nozzles directed at said outer tube wall from said plenum, and means supplying cleaning fluid under pressure to said plenum for delivery by said nozzles onto said outer tube wall.

11. The cleaning fluid distribution head according to claim 10, in which said plenum is integrally formed with said head structure support.

12. The cleaning fluid distribution head according to claim 11, in which said head structure and its support are cooperatively threaded, and said plenum defines weep holes and a downward slope to its horizontal surfaces against accumulation of cleaning fluid thereon.

13. The cleaning fluid distribution head according to claim 1, in which said fluid redirecting means comprises an impeller freely rotatable about its axis responsive to impingement by said cleaning fluids.

14. The cleaning fluid distribution head according to claim 13, in which said impeller comprises a plurality of blades extending outward from a common hub, said blades having a pitch angle deflecting impinging fluid laterally of said impeller and centrifugally onto the inner wall of said tube.

15. The cleaning fluid distribution head according to claim 14, in which the radial orientation and angular extent of said impeller blades is such that gaps are defined between adjacent blades in cleaning fluid axially passing relation.

16. The cleaning fluid distribution head according to claim 15, including also means beyond said tube supporting said structure within said tube, said impeller disposed normally within said tube and inwardly spaced from said tube inner wall.

17. The cleaning fluid distribution head according to claim 16, in which said structure includes a plug shaped body having a longitudinal axis coincident with the tube longitudinal axis, a series of transverse bores extending within said body from respective ones of said inlets, and a series of axial bores extending within said body from respective ones of said outlets, said axial and transverse bores intersecting in paired relation to define separate passageways between said inlets and outlets for different fluids to be delivered onto said impeller blades and therepast through said gaps to clean said tube along its entire length.

18. The cleaning fluid distribution head according to claim 17 in which said transverse bores lie in different axial planes and generally parallel to the locus of rotation of said impeller.

19. The cleaning fluid distribution head according to claim 18, in which said axial bores are of different lengths and at least two axial bores extend to a given transverse bore plane to intersect with each said transverse bore, said intersecting bores terminating in outlets which are diametrically opposed and lie in a common plane with the impeller hub axis of rotation.

20. The cleaning fluid distribution head according to claim 19, in which said axial bores diverge outwardly within said body toward said outlets to deliver cleaning fluid radially outwardly and downardly onto or between said impeller blades.

21. The cleaning fluid distribution head according to claim 13, including also a housing adapted to overfit an end of said tube in upright orientation, said housing defining a central support for said head structure including means engaging an upper portion of said cleaning head, a plenum surrounding said head structure in radially spaced relation whereby said tube is received between said head and said plenum, a spindle extending axially from said head, said impeller being freely rotatably journaled on said spindle, said outlets being circularly distributed about said spindle for delivery of cleaning fluid onto and past said impeller for cleaning the interior of said tube, a plurality of nozzles directing fluid from said plenum generally radially inwardly for cleaning the exterior of said tube, said plenum and outlets being adapted to sequentially communicate in common with a series of different cleaning fluid supplies, means supplying different cleaning fluids, and means to collect said cleaning fluids after use.

* * * * *